US007414372B2

(12) United States Patent
Ribarich

(10) Patent No.: US 7,414,372 B2
(45) Date of Patent: Aug. 19, 2008

(54) DIMMING BALLAST CONTROL CIRCUIT

(75) Inventor: Thomas J. Ribarich, Laguna Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 11/551,435

(22) Filed: Oct. 20, 2006

(65) Prior Publication Data

US 2007/0090775 A1 Apr. 26, 2007

Related U.S. Application Data

(60) Provisional application No. 60/729,586, filed on Oct. 24, 2005.

(51) Int. Cl.
*G05F 1/00* (2006.01)

(52) U.S. Cl. ..... 315/307; 315/291; 315/360; 315/224; 315/209 R; 315/DIG. 4

(58) Field of Classification Search ..... 315/291, 315/307, 224, 209 R, 246, 247, 360, 362, 315/DIG. 4, DIG. 7, 244
See application file for complete search history.

(56) References Cited

U.S. PATENT DOCUMENTS 4,651,060 A 3/1987 Clark ..... 315/199
4,700,111 A 10/1987 Folwell et al. ..... 315/200 R
5,550,436 A * 8/1996 Houk ..... 315/209 R
5,612,594 A 3/1997 Maheshwari ..... 315/224
5,696,431 A 12/1997 Giannopoulos et al. ..... 315/308
5,850,127 A * 12/1998 Zhu et al. ..... 315/307
6,008,593 A 12/1999 Ribarich ..... 315/307
6,218,788 B1 * 4/2001 Chen et al. ..... 315/225
6,366,124 B1 * 4/2002 Kwong ..... 326/81
6,603,274 B2 * 8/2003 Ribarich et al. ..... 315/291
6,879,115 B2 * 4/2005 Ribarich ..... 315/224

FOREIGN PATENT DOCUMENTS

WO WO 93/25952 12/1993
WO WO 99/41953 8/1999

OTHER PUBLICATIONS

Extended European Search Report, Feb. 13, 2007.

* cited by examiner

*Primary Examiner*—Haissa Philogene
(74) *Attorney, Agent, or Firm*—Ostrolenk, Faber, Gerb & Soffen, LLP

(57) ABSTRACT

A dimming ballast control circuit for driving a ballast power switching circuit powering a gas discharge lamp. The circuit includes a driver circuit for driving high and low side switches of the ballast power switching circuit; a control circuit for driving the driver circuit including an oscillator circuit for providing an oscillating signal to control the frequency of operation of the ballast power switching circuit, the ballast power switching circuit outputting lamp powering pulsed signals; and a dimming control circuit having an input, the dimming control circuit receiving an AC lamp current feedback signal at the input, the dimming control circuit further receiving a DC input voltage reference at the input whereby the DC input voltage reference determines a desired dimming level of the lamp and the AC lamp current feedback signal maintains the lamp brightness at the desired dimming level.

23 Claims, 4 Drawing Sheets

DIMMING BALLAST CONTROL CIRCUIT

CROSS-REFERENCE TO RELATED APPLICATION

This application is based on and claims the benefit of U.S. Provisional Application Ser. No. 60/729,586, filed on Oct. 24, 2005, entitled DIMMING BALLAST CONTROL INTEGRATED CIRCUIT, to which a claim of priority is hereby made and the disclosure of which is incorporated by reference.

BACKGROUND OF THE INVENTION

The present invention relates to dimming ballast controls, and more particularly to a dimming ballast control integrated circuit for controlling a ballast driving a gas discharge lamp, for example, a fluorescent lamp or a compact fluorescent lamp.

Ballast control integrated circuits often are unnecessarily complex from the standpoint of the number of pins/connections necessary to implement a ballast circuit using the integrated circuit. Often, these circuits have over 8 pins and if a dimming function is included, a separate pin is required for both setting the dimming level and for feedback control to maintain the desired dimming level.

A ballast control IC that has a reduced number of pins and minimal external circuitry is desirable.

SUMMARY OF THE INVENTION

It is an object of the present invention to provide a dimming ballast control circuit with a reduced pin and component count. The circuit includes a driver circuit for driving high and low side switches of a ballast power switching circuit, a control circuit for driving the driver circuit including an oscillator circuit for providing an oscillating signal to control the frequency of operation of the power switching circuit; the power switching circuit providing lamp powering pulsed signals; and a dimming control circuit, the dimming control circuit having an input, the dimming control circuit receiving an AC lamp current feedback signal at the input, the dimming control circuit further receiving a DC input voltage reference at the input for setting a dimming level of the lamp, the AC lamp current feedback signal maintaining the lamp at the desired dimming level. With the circuit of the invention, a single input is used for both setting the dimming level and maintaining the lamp power at the desired dimming level.

Thus, an integrated circuit with a reduced component and pin count is provided. The input used for dimming is also used to maintain, through feedback from the lamp output stage, the desired intensity level of the lamp output.

Other features and advantages of the present invention will become apparent from the following description of the invention that refers to the accompanying drawings.

DETAILED DESCRIPTION OF EMBODIMENTS OF THE INVENTION

Figure 1:
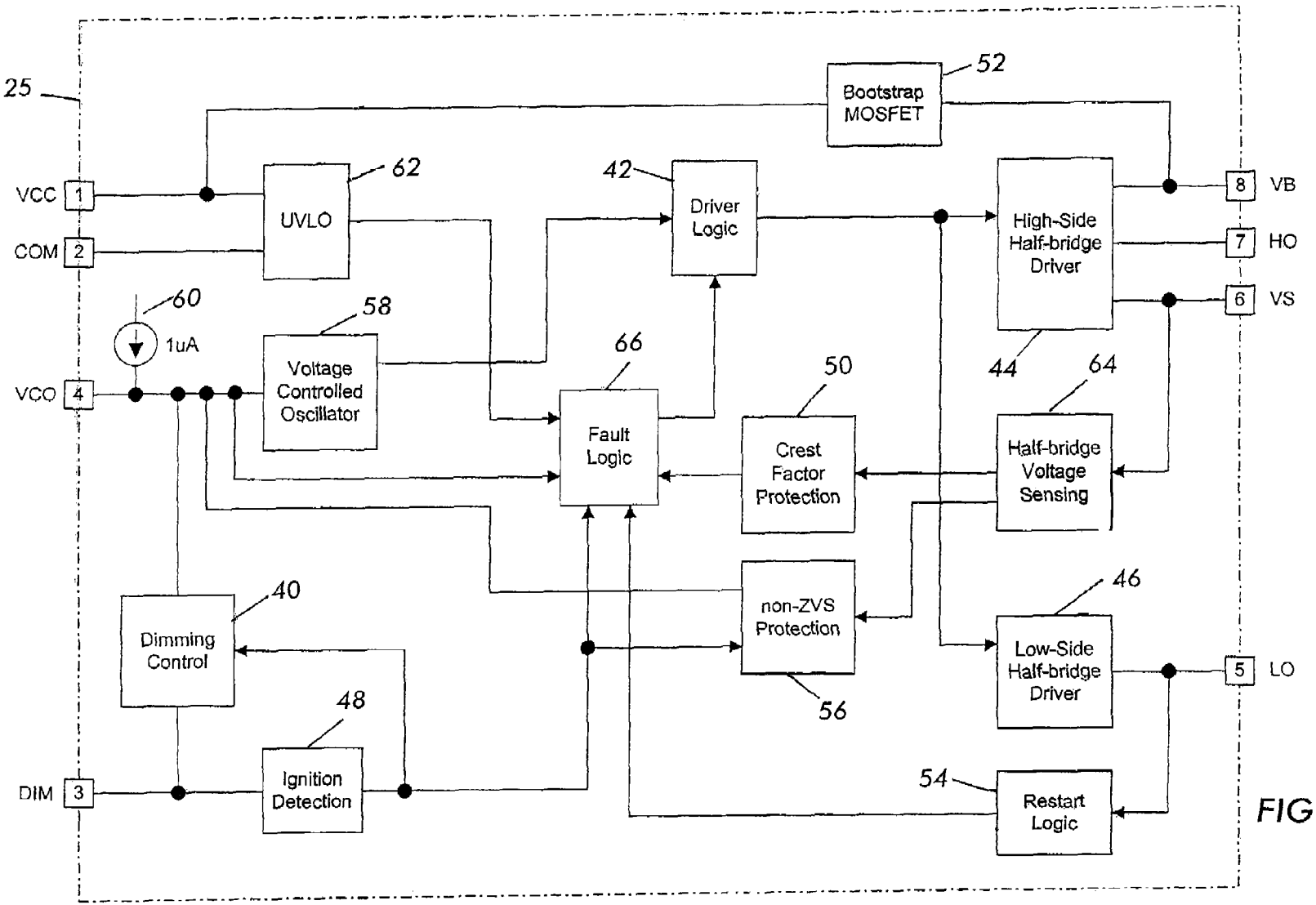
FIG. 1 is a block diagram of the dimming ballast control IC of the present invention.
Figure 4:
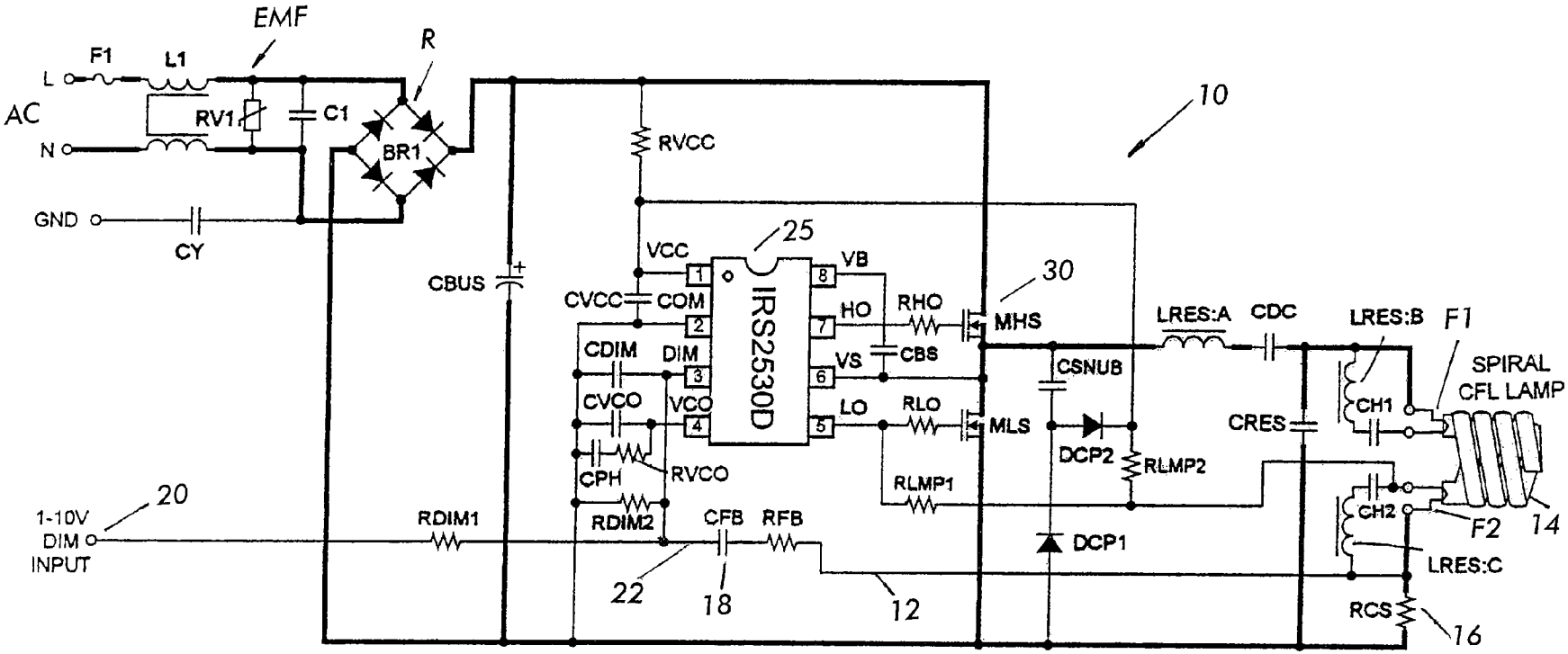
FIG. 4 is a circuit diagram of a typical application of the dimming ballast control IC of the present invention.

FIG. 1 illustrates an 8-pin dimming ballast control integrated circuit (IC) 25. FIG. 4 shows the IC 25 in a ballast circuit powering a lamp 14. The IC 25 realizes a simple, high-performance dimming ballast solution. In the embodiment shown, the ballast control is obtained by an integrated circuit having only 8 pins. VCC pin 1 supplies a logic and internal gate drive power voltage $V_{CC}$ for powering the IC. This voltage is also provided to an Undervoltage Lockout (UVLO) circuit 62 and the bootstrap switch 52. UVLO circuit 62 provides under voltage lock out protection to prevent operation of the output driver stage when Vcc is below a threshold level. Bootstrap circuit 52 provides the high side driver stage voltage for powering the high side driver at a voltage level $V_B$ above voltage $V_{CC}$. COM pin 2 is the IC power and signal ground also provided to the UVLO circuit 62. Signals from the UVLO circuit 62 are provided to a Fault Logic circuit 66.

DIM pin 3 provides a dimming control and feedback input to a Dimming Control circuit 40, which provides a signal input to a Voltage-Controlled Oscillator 58. An Ignition Protection circuit 48 also receives its input from DIM pin 3 and provides an output to the Dimming Control circuit 40. The DC DIM input voltage reference 20 (FIG. 4) and the AC lamp current feedback 12 (FIG. 4) are coupled together allowing a single pin, DIM pin 3, to be used for dimming and feedback control of the lamp's brightness level.

VCO pin 4 provides an input from the voltage on a charging capacitor to the Voltage-Controlled Oscillator circuit 58 to control its frequency of operation necessary for dimming. It is also provides frequency sweep time for a preheat/ignition mode to a Fault Logic circuit 66. An internal current source boost circuit 60 is connected to VCO pin 4 for charging up an external capacitor CPH (FIG. 4).

LO pin 5 provides a driver output from a low side Half-Bridge Driver circuit 46, which driver output is provided to drive the low side switch of the ballast circuit. LO pin 5 is also provided as input to a Restart Logic circuit 54 during UVLO or Fault Mode. This input is a generic shutdown function and is used to detect lamp presence in this application.

VS pin 6 is coupled to the switching mode Vs of the output half-bridge ballast circuit and receives high-side Half-Bridge Driver voltage floating supply and provides input for a Half-Bridge Current and Voltage sensing circuit 64. The circuit 64 provides input to a non-Zero Voltage Switching (ZVS) Protection circuit 56 and a Crest Factor Protection circuit 50. The single high-voltage VS pin 6 senses the Half-Bridge current and voltage to perform necessary ballast protection functions.

HO pin 7 provides a driver output from a high side Half-Bridge Driver circuit 44 to the high side switch of the ballast circuit. VB pin 8 provides the high-side Half-Bridge Driver floating supply controlled by the bootstrap switch 52.

The IC 25 includes a Zener clamp structure (not shown) between VCC pin 1 and COM pin 2. The Zener clamp has a nominal breakdown voltage of, for example, 15.6 V. This supply should not be driven by a low impedance DC power source greater than the $V_{CLAMP}$ specified in Table 3. Enough current should be supplied to the VCC pin 1 to keep the internal 15.6V Zener diode clamping the voltage at this pin. Also, output switching conditions where the VS pin 6 flies inductively below ground by more than 5V should be avoided.

The IC 25 further includes a Driver Logic circuit 42, which receives the oscillating output signal of the VCO 58 as an input. It also has an input from the Fault Logic circuit 66. Driver Logic circuit 42 controls the high-side and low-side half-bridge drivers 44 and 46. The Fault Logic circuit 66, in addition to the input from the UVLO circuit 62, further receives input from the Restart Logic circuit 54, the Ignition Detection circuit 48, and the Crest Factor Protection circuit 50 to provide ballast protection.

As described above, the IC 25 thus includes the closed-loop lamp current Dimming Control circuit 40; the Driver Logic circuit 42 driving High-Side and Low-Side Half-Bridge Drivers 44 and 46; the Ignition Detection 48; the Crest Factor Protection circuit 50; the bootstrap switch 52; the lamp Restart Logic circuit 54; the non-ZVS Protection circuit 56, to provide a non-ZVS protection and a Zener clamp diode on $V_{CC}$, e.g., 15.6V. The IC 25 also includes a programmable preheat time; fixed dead-time (1.5 us typ.); a micropower startup, e.g., 200 μA and latch immunity and ESD protection.

Figure 2:
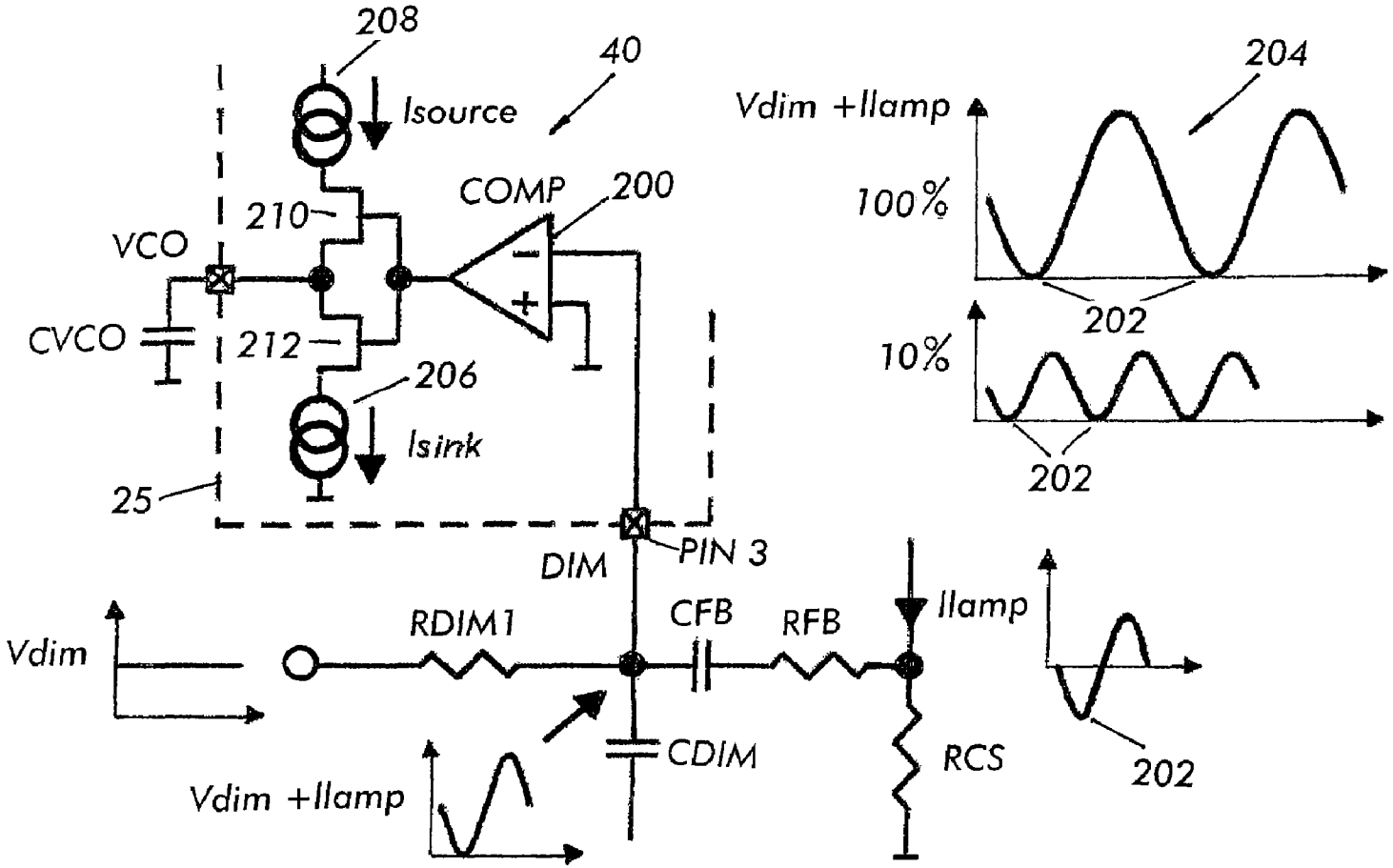
FIG. 2 is a circuit diagram of a portion of the circuit of FIG. 1 providing common AC and DC input to the dimming ballast control IC of the present invention for setting the dimming level and maintaining the dimming level through output stage feedback.

FIG. 2 illustrates the circuit 40 inside IC 25 coupled to DIM pin 3 showing how the single input at DIM pin 3 is used for dimming and to maintain the desired intensity level of the lamp output using feedback from the lamp output stage. The circuit 40 located inside the IC 25, includes a comparator 200 receiving the input from DIM pin 3. An output of the comparator 200 is connected to gates of a pair of series connected switches 210 and 212, wherein first switch 210 is PMOS and is connected to a current source 208 and second switch 212 is NMOS and is connected to a current sink 206. Typically about 625 uA sink (discharge) current and 160 uA source (charge) current is used. This gives a sink to source current ratio, which is important for stable dimming, of about 4:1.

An explanation will now be provided concerning the operation of dimming control circuit 40, which functions to set and maintain, via lamp feedback, the desired dimming level.

DIM pin 3 of IC 25 receives two signals, a DC level $V_{DIM}$ which is provided externally by resistor RD 1M1 from a dimming input, typically 1-10V DC to set the dimming level, and a AC signal I lamp decoupled by an AC coupling capacitor CFB from a voltage developed across a damp current sensing resistor RCS.

The voltage at pin 3 represents the combination of a dimming voltage $V_{DIM}$ (a DC level) and an AC signal representing the lamp current I lamp and will be a sinusoid 204. The comparator 200 compares the valley 202 of the sinusoid 204 at DIM pin 3 with COM (zero). If the valley 202 dips below COM then the comparator 200 output goes 'high' and turns on the lower NMOS FET 212 that connects a sink current 206 to VCO pin 4. This sink current slightly discharges the capacitor CVCO voltage at VCO pin 4 to increase the frequency. The increase in frequency causes the sinusoid amplitude (the lamp current) to decrease slightly so that the valley of the sinusoid increases to a position above COM.

If the valley 202 of the sinusoid is above zero, the comparator output is 'low' and the upper PMOS FET 210 turns on to connect a source current 208 to VCO pin 4. This source current increases the capacitor CVCO voltage at VCO pin to decrease the frequency slightly. This will increase the lamp current and therefore the sinusoid amplitude causing the valley to eventually decrease to a position at COM level. Hence, the circuit 40 is always trying to vary the frequency to force the sinusoid valley 202 to COM. But whenever the valley 202 reaches COM, sink pulses are delivered to the VCO to again increase the frequency to raise the valley above COM. By doing this every cycle, the valley will eventually regulate right at COM and the VCO voltage will reach a steady-state value, determined by the sink and source currents, thereby maintaining the dimming level of the lamp at the value determined by $V_{DIM}$.

The VCO voltage sets a frequency which gives the correct lamp current amplitude. The ballast half-bridge (see 30 of FIG. 4) is always operating at 50% duty-cycle and a fixed dead-time with only the frequency being controlled to keep the lamp current regulated to the correct level. The resonant output stage (LRESA in series with a parallel R and CRES) (FIG. 4) has a transfer function, i.e., gain vs. frequency, that increases the lamp current as the frequency is decreased and decreases the lamp current as the frequency is increased.

Figure 3:
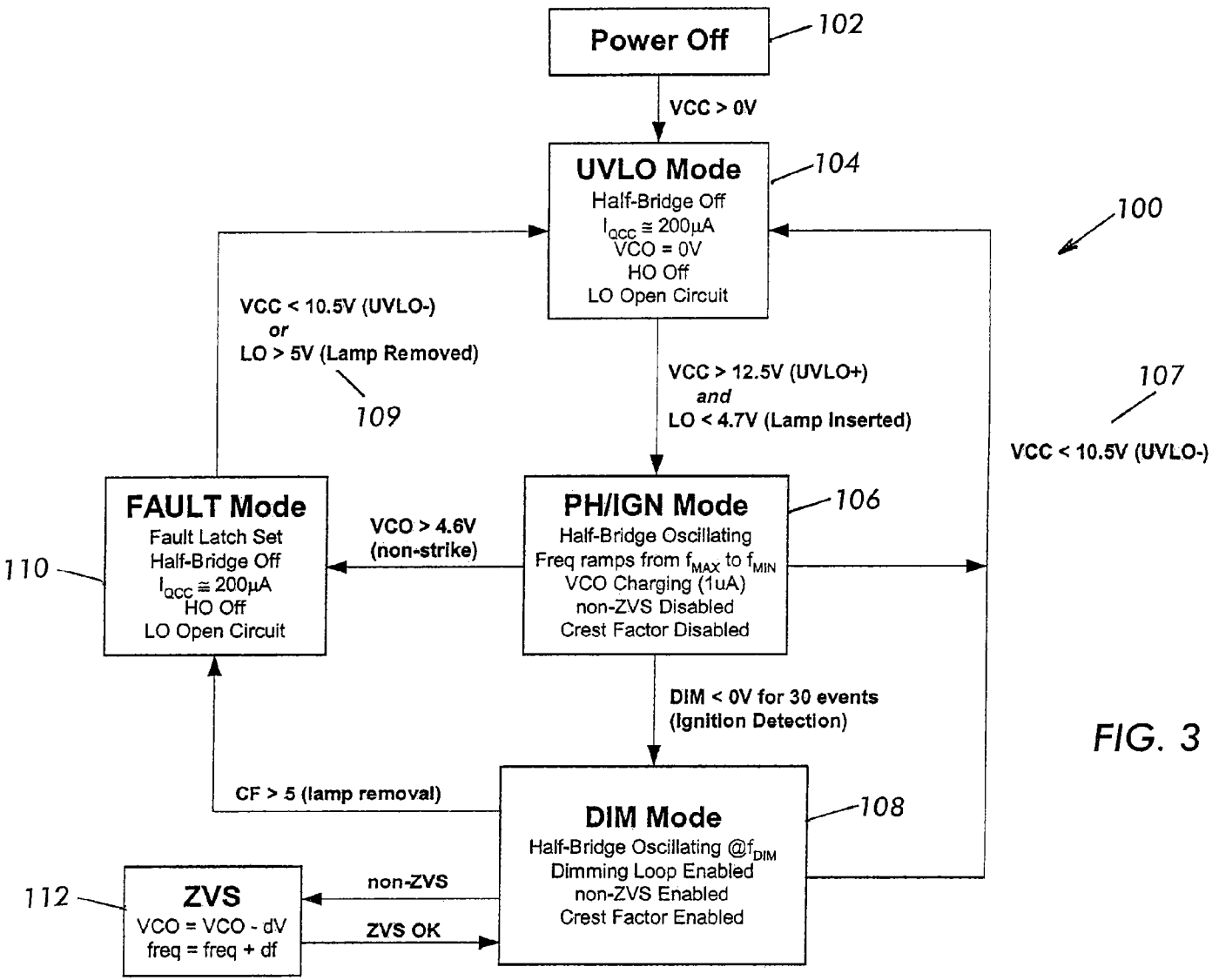
FIG. 3 is a state diagram for the dimming ballast control IC of the present invention.

FIG. 3 illustrates the state diagram 100 of IC 25. When the power is first turned on in step 102, i.e., $V_{CC}$ at VCC pin 1 is greater than 0, the IC 25 enters a UVLO mode in step 104. In the UVLO mode the followings settings are established: the half bridge 30 (FIG. 1) is OFF, $I_{QCC}$≈200 μA; VCO pin 4 is equal to 0V; HO pin 7 is OFF and LO pin 5 is an open circuit.

When, VCC pin 1 becomes greater than 12.5V (UVLO+) and the LO pin 5 less than 4.7V, which indicates that the lamp is inserted, the IC 25 enters a pre heating/ignition mode at step 106. While the IC 25 is in pre heating/ignition mode and the lamp does not ignite there will be no AC component at the DIM pin and the DIM voltage will remain at a DC level. The VCO will thus eventually charge up above 4.6V and then enter Fault Mode and shutdown. The Fault Logic circuit 66 has an input coupled to VCO. If the lamp ignites, the ignition-detection circuit 48 of IC 25 will detect a lamp current because the valley 202 of sinusoid at DIM pin 3 will decrease below COM for about 30 events. When this occurs, the IC enters DIM mode In the pre heating/ignition mode the following settings are established: the half-bridge oscillating frequency ramps from $f_{MAX}$ to $f_{MIN}$; VCO pin 4 is charging (1 uA); the crest factor and non-ZVS are fault disabled. Further, when DIM pin 3 remains under 0V for 30 events, IC 25 enters a DIM mode in step 108, else, the IC 25 returns to the UVLO mode.

Once ignition is detected the IC 25 enters the DIM mode, the sink/source dimming control of circuit 40 (FIG. 2) is activated. If the lamp is removed during DIM mode, the dimming control loop or the non-ZVS will regulate the frequency towards resonance until the inductor saturates. The inductor saturation will cause the inductor current crest factor CF (peak-to-average) to exceed 5 which will then cause the IC 25 to enter Fault Mode at step 110 and shutdown.

In the DIM mode the followings settings are established: the half-bridge oscillating frequency is set at $f_{DIM}$; a dimming loop is enabled; the crest factor an the non-ZVS protection are enabled.

If the voltage at VCC pin 1 is less than 10.5V (UVLO−), the IC 25 returns to the UVLO mode, from any state, as shown in 107 or 109. For non-ZVS, the IC 25 enters a ZVS mode in step 112 where the value of VCO pin 4 is reduced, i.e., VCO=VCO−dV and the half-bridge oscillating frequency is increased, i.e., freq.=freq.+df and the IC 25 returns to the DIM mode. Thus, the switches are driven towards zero voltage switching by the ZVS loop.

Alternatively, if the crest factor is greater than 5 (when the lamp has not ignited, e.g., is removed) or VCO is less than 0.85V (non-ZVS) the IC 25 enters a Fault mode at step 110. In the Fault mode a fault Latch is Set, the half-bridge is OFF; $I_{QCC}$≈200 μA; HO pin 7 output is OFF; and LO pin 2 is an open circuit.

From the Fault mode, when the voltage on VCC pin 1 is less than 10.5V (UVLO−) or LO pin 5 is greater than 5V, i.e., lamp is removed, the IC 25 returns to the UVLO mode.

FIG. 4 illustrates a diagram of a typical application using IC 25 of the present invention in a dimming ballast circuit 10. The ballast circuit 10 couples the AC feedback signal 12 from the lamp 14 to the DC DIM signal at pin 3. As described, this allows use of a single IC pin for both dimming and feedback. The IC lamp current sensing resistor is RCS 16. The AC lamp current signal 12 is coupled by feedback resistor RFB and capacitor CFB 18 to the dimming input 20. The DC DIM signal is provided at the DIM input 20 and may comprise a 1 to 10 volt variable DC level. The DIM input 20 is provided to a voltage divider circuit formed by resistors RDIM2 and RDIM1. An additional capacitor CDIM is provided for noise filtering and is smaller than the coupling capacitor CFB 18. Typically, the capacitor CFB 18 equals 470 nF and the capacitor CDIM equals 1 nF.

The AC lamp current feedback signal 12 is superimposed by capacitor CFB 18 on the DC dim voltage at 22. The DIM level 20 controls the peak lamp current and the feedback signal 12 maintains the dimming level at the desired value. Accordingly, only one pin of the control IC 25, i.e., pin 3, is used to provide the desired dimming level (DC) and maintain the dimming or brightness level at the desired level through the AC feedback signal 12.

The dimming ballast circuit 10 of FIG. 4 provides a simple lamp current dimming control method using a single 8-pin chip dimming solution. The ballast circuit 10 requires only a single resistor for lamp current sensing. Also, a current sensing resistor in series with the half-bridge is not required. External protection circuits and an external bootstrap diode are not required. Moreover, the circuit 10 provides large reduction in component count and increased manufacturability and reliability. It is also easy to use for fast design cycle time.

Table 1 illustrates Absolute Maximum Ratings of the control IC 25, it indicates sustained limits beyond which damage to the control IC 25 may occur. All voltage parameters are absolute voltages referenced to COM. All currents are defined positive into any lead. The Thermal Resistance and Power Dissipation ratings are measured under board mounted and still air conditions.

TABLE 1

| Parameter | | | | |
|---|---|---|---|---|
| Symbol | Definition | Min. | Max. | Units |
| $V_B$ | High-Side Floating Supply Voltage | −0.3 | 625 | V |
| $V_S$ | High-Side Floating Supply Offset Voltage | $V_B - 25$ | $V_B + 0.3$ | V |
| $V_{HO}$ | High-Side Floating Output Voltage | $V_S - 0.3$ | $V_B + 0.3$ | V |
| $V_{LO}$ | Low-Side Output Voltage | −0.3 | $V_{CC} + 0.3$ | V |

TABLE 1-continued

| Parameter | | | | |
|---|---|---|---|---|
| Symbol | Definition | Min. | Max. | Units |
| $V_{VCO}$ | VCO Input Voltage | −0.3 | 6 | V |
| $V_{DIM}$ | DIM Input Voltage | −0.3 | $V_{CC} + 0.3$ | V |
| $I_{CC}$ | Supply Current (Note 1) | — | 20 | mA |
| IOMAX | Maximum allowable current at LO, HO and PFC due to external power transistor Miller effect. | −500 | 500 | |
| $dV_s/dt$ | Allowable VS Pin Voltage Stew Rate | −50 | 50 | V/ns |
| $P_D$ | Maximum Power Dissipation @ TA ≦ +25° C., 8-Pin DIP | — | 1.0 | W |
| $P_D$ | Maximum Power Dissipation @ TA ≦ +25° C., 8-Pin SOIC | — | 0.625 | W |
| $R_{\theta JA}$ | Thermal Resistance, Junction to Ambient, 8-Pin DIP | — | 85 | ° C./W |
| $R_{\theta JA}$ | Thermal Resistance, Junction to Ambient, 8-Pin SOIC | — | 128 | ° C./W |
| $T_J$ | Junction Temperature | −55 | 150 | ° C. |
| $T_S$ | Storage Temperature | −55 | 150 | |
| $T_L$ | Lead Temperature (Soldering, 10 seconds) | — | 300 | |

For proper operation, recommended conditions within which the control IC 25 should be used are provided in Table 2.

TABLE 2

| Parameter | | | | |
|---|---|---|---|---|
| Symbol | Definition | Min. | Max. | Units |
| $V_{BS}$ | High-Side Floating Supply Voltage | $V_{CC} - 0.7$ | $V_{CLAMP}$ | V |
| $V_S$ | Steady State High-Side Floating Supply Offset Voltage | −3.0 (Note 2) | 600 | V |
| $V_{CC}$ | Supply Voltage | $V_{CCUV+} + 0.1$ V | $V_{CC\ CLAMP}$ | V |
| $I_{CC}$ | Supply Current | (Note 3) | 5 | mA |
| $T_J$ | Junction Temperature | −40 | 125 | ° C. |

Electrical characteristics of the IC 25, where VCC=VBS=14V, VS=0V, and TA=25° C. unless otherwise specified, are provided below in Table 3. The output voltage and current ($V_O$ and $I_O$) parameters are referenced to COM and are applicable to the respective HO and LO output leads.

TABLE 3

| Symbol | Definition | Min | Typ | Max | Units | Test Conditions |
|---|---|---|---|---|---|---|
| | Low Voltage Supply Characteristics | | | | | |
| $V_{CLAMP}$ | $V_{CC}$ Zener Clamp Voltage | 14.6 | 15.4 | 16.6 | V | $I_{CC}$ = 10 Ma |
| $V_{CCUV+}$ | Rising $V_{CC}$ Undervoltage Lockout | 11.5 | 12.5 | 13.5 | | |
| $V_{CCUV-}$ | Falling $V_{CC}$ Undervoltage Lockout | 9.5 | 10.5 | 11.5 | | |
| $V_{CCUVHYS}$ | $V_{CC}$ Undervoltage Lockout Hysteresis | 1.5 | 2.0 | 3.0 | | |
| $I_{CCUV}$ | Micropower Startup $V_{CC}$ Supply Current | — | 200 | — | μA | $V_{CC}$ = 8 V |
| $I_{CCDIM}$ | Run Mode $V_{CC}$ Supply Current | — | 2.5 | — | mA | MODE = DIM |

TABLE 3-continued

| Symbol | Definition | Min | Typ | Max | Units | Test Conditions |
|---|---|---|---|---|---|---|
| $I_{CCFLT}$ | Fault Mode $V_{CC}$ Supply Current | — | 300 | — | μA | MODE = FAULT |
| | Floating Supply Characteristics | | | | | |
| $I_{QBS}$ | Quiescent $V_{BS}$ Supply Current | — | 60 | 80 | μA | |
| $V_{BSUV+}$ | Rising $V_{BS}$ Supply Undervoltage Threshold | 8.5 | 9.0 | 9.5 | V | |
| $V_{BSUV-}$ | Falling $V_{BS}$ Supply Undervoltage Threshold | 7.6 | 8.0 | 9.0 | | |
| $I_{LK}$ | Offset Supply Leakage Current | — | — | 50 | μA | $V_B = V_S = 600$ V |
| | Ballast Control Characteristics | | | | | |
| $f_{MIN}$ | Minimum Output Frequency | 33 | 35 | 37 | kHz | VCO = 6 V |
| $f_{MAX}$ | Maximum Output Frequency | — | 100 | — | | VCO = 0 V |
| d | Duty Cycle | — | 50 | — | % | |
| DT | Output Deadtime (HO or LO) | — | 2.0 | — | usec | MODE = ALL |
| $I_{VCO}$ | VCO Pin Charging Current | — | 1 | — | uA | MODE = PH/IGN |
| $V_{RSRT}$ | LO Pin Lamp Insert Re-start Threshold | — | 5.0 | — | V | MODE = FAULT |
| $V_{RSRTHYS}$ | LO Pin Re-start Threshold Hysteresis | — | 300 | — | mV | MODE = FAULT |
| $n_{EVENTSIGN}$ | Ignition Detection No. of Events | — | 30 | — | N/A | MODE = PH/IGN DIM = −0.5 V |
| $V_{ZVSTH}$ | VS Non-ZVS Detection Threshold | — | 5.0 | — | V | MODE = DIM, LO = HIGH |
| $V_{VCOFLT+}$ | VCO Fault Rising Threshold | — | 4.6 | — | V | MODE = PH/IGN |
| $C_{SCF}$ | Crest Factor Fault Factor | — | 5.0 | — | N/A | MODE = DIM, VS offset = 0.5 V |
| $VS_{_OFFSET_MAX}$ | Maximum Crest Factor VS Offset Voltage | — | 3.0 | — | V | |
| | Dimming Control Characteristics | | | | | |
| $V_{DIMREG}$ | DIM Regulation Threshold | — | 0.0 | — | V | MODE = DIM |
| $I_{VCO+}$ | VCO Dimming Source Current | — | 160 | — | μA | MODE = DIM |
| $V_{VCO-}$ | VCO Dimming Sink Current | — | 625 | — | μA | MODE = DIM |
| | Gate Driver Output Characteristics (HO and LO) | | | | | |
| $V_{OH}$ | High-Level Output Voltage | — | $V_{CC}$ | — | | $I_O = 0$ A |
| $V_{OL}$ | Low-Level Output Voltage | — | COM | — | | $I_O = 0$ A |
| VOL_UV | UV-Mode Output Voltage | — | COM | — | | $I_O = 0$ A, $V_{CC} \leqq V_{CCUV-}$ |
| $t_R$ | Output Rise Time | — | 120 | 220 | nsec | |
| $t_F$ | Output Fall Time | — | 50 | 80 | | |
| $t_{SD}$ | Shutdown Propagation Delay | — | 350 | — | | |
| $I_{O+}$ | Output source current | — | 180 | mA | mA | |
| $I_{O-}$ | Output sink current | — | 260 | — | | |
| | Bootstrap FET Characteristics | | | | | |
| VB_ON | VB when the bootstrap FET is on | | 13.7 | | V | |
| IB_CAP | VB source current when FET is on | 5 | 55 | | mA | CBS = 0.1 uF |
| IB_10 V | VB source current when FET is on | 8 | 12 | | | VB = 10 V |

The circuit 10 of FIG. 4 includes an AC main power supply comprising a bridge rectifier R and input Filter EMF as well as a DC bus capacitor CBUS. Additionally, a VCO charging capacitor CVCO in parallel with series resistor RVCO and capacitor CPH, for providing good stability during dimming at low brightness levels. The resistor RVCO is small enough (about 1 k Ohm) such that the voltage at VCO pin 4 will ramp up as the capacitor CPH ramps up. The frequency will decrease as voltage at VCO pin 4 ramps up until the lamp ignites. Thus, the CPH capacitor, which is charged up through an internal current source, programs the preheat/ignition timing. The combination of CPH and RVCO also provide an additional compensation network for the dimming feedback loop for stable dimming at low brightness levels.

The circuit 10 further includes a VCC filter capacitor CVCC, a bootstrap charging capacitor CBS, voltage reducing resistor RVCC, gate drive resistor RHO and RLO, snubber capacitor CSNUB, charge pump diodes DCP1 and DCP2, having voltage sensing resistor RLMP1 and RLMP2 for sensing the lamp voltage (provided to restart circuit 54) are also provided.

If the lamp is removed during the Fault or UVLO modes, a lower lamp filament connection will become an open circuit and the voltage sensing resistor RLMP2 will pull LO pin 5 through RLMP1 above an internal threshold set at 5 V. This will hold the IC 25 in the UVLO mode. When the filament is re-inserted, the lower lamp filament will pull the node between the voltage sensing resistors RLMP1 and RLMP2 to a level near COM and will therefore pull LO pin 5 below the internal threshold of 4.7V and the IC 25 will restart in the preheat/ignition mode.

In addition, the lamp output circuit includes the output resonant inductors LRESA, LRESB and LRESC, as well as resonant capacitor CRES, DC blocking capacitor CDC and capacitors CH1 and CH2. During filament preheating, the filaments F1 and F2 are heated by the preheat voltage provided during the preheat mode. Once the lamp strikes and ignites, the resonant circuits comprising LRESB and CH1 and LRESC and CH2 are bypassed by the low lamp impedance when the lamp is lit.

Although the present invention has been described in relation to particular embodiments thereof, many other variations and modifications and other uses will become apparent to those skilled in the art. It is preferred, therefore, that the present invention not be limited by the specific disclosure herein.

What is claimed is:

1. A dimming ballast control circuit for driving a ballast power switching circuit powering a gas discharge lamp comprising:

a driver circuit for driving high and low side switches of the ballast power switching circuit;

a control circuit for driving the driver circuit including an oscillator circuit for providing an oscillating signal to control the frequency of operation of the ballast power switching circuit, the ballast power switching circuit outputting lamp powering pulsed signals; and a dimming control circuit having an input, the dimming control circuit receiving an AC lamp current feedback signal at the input, the dimming control circuit further receiving a DC input voltage reference at the input whereby the DC input voltage reference determines a desired dimming level of the lamp and the AC lamp current feedback signal maintains the lamp brightness at the desired dimming level, wherein said AC lamp current signal is superimposed on said DC input voltage reference at the input to provide a time varying signal having a DC level.

2. The circuit of claim 1, wherein the dimming control circuit compares a feature of said time varying signal with a reference level, and if the feature of the time varying signal varies from the reference level, adjusts a control input to said oscillator circuit to vary the frequency of said oscillator circuit to drive said feature of said time varying signal so that it has the same level as the reference level.

3. The circuit of claim 2, wherein the feature is a valley of said time varying signal and the reference is a ground level of the circuit.

4. The circuit of claim 2, wherein the oscillator circuit is a voltage controlled oscillator having a charging capacitor at its input and the dimming control circuit charges and discharges said charging capacitor to change the frequency of the oscillating signal.

5. The circuit of claim 4, wherein the dimming control circuit comprises:

first and second series connected switches;

a comparator receiving the input and providing an output to gates of the first and second switches; and a current source and a current sink circuit connected to one terminal of each of the first and second switches, respectively, a common connection between the switches being coupled to said charging capacitor.

6. The circuit of claim 5, wherein the first switch is PMOS and the second switch is NMOS, the first switch being connected to the current source and the second switch being connected to the current sink.

7. The circuit of claim 6, wherein sink to source current ratio is about 4:1, the sink current being used to discharge and the source current being used to charge the charging capacitor coupled to the voltage-controlled oscillator control input.

8. The circuit of claim 5, wherein the feature comprises the voltage level of a valley of the time varying signal at the input and, if the valley is below the reference level, then the comparator output is HIGH and if the valley is above the reference level, then the comparator output is LOW.

9. The circuit of claim 8, wherein the HIGH comparator output turns ON the second switch, which discharges the charging capacitor, increases the frequency of the driver circuit, causing a decrease in amplitude of the time varying signal and the lamp current, and increases the voltage level of the valley of the time varying signal to a position above the reference level; and the LOW comparator output turns ON the first switch, which increases a charge of the charging capacitor, decreases the frequency of the driver circuit, causing an increase in the amplitude of the time varying signal and the lamp current, and decreases the voltage level of the valley of the time varying signal to a position below the reference level, said ballast power switching circuit operating with a fixed duty cycle.

10. The circuit of claim 9, wherein the duty cycle is 50% and a dead time is fixed.

11. The circuit of claim 1, further comprising a bootstrap switch circuit receiving a supply voltage from the circuit and controlling a voltage floating voltage supply (VB) provided to the high-side switch of the driver circuit.

12. The circuit of claim 1, wherein the circuit is contained in an integrated circuit.

13. The circuit of claim 12, wherein the integrated circuit has at most 8 pins.

14. A dimming ballast control circuit for driving a ballast power switching circuit powering a gas discharge lamp comprising:

a driver circuit for driving high and low side switches of the ballast power switching circuit;

a control circuit for driving the driver circuit including an oscillator circuit for providing an oscillating signal to control the frequency of operation of the ballast power switching circuit, the ballast power switching circuit outputting lamp powering pulsed signals;

a dimming control circuit having an input, the dimming control circuit receiving an AC lamp current feedback signal at the input, the dimming control circuit further receiving a DC input voltage reference at the input whereby the DC input voltage reference determines a desired dimming level of the lamp and the AC lamp current feedback signal maintains the lamp brightness at the desired dimming level; and a feedback capacitor for coupling a voltage proportional to current through the lamp to said input;

whereby an AC voltage proportional to the lamp current is superimposed on said DC input voltage reference that sets the desired dimming level.

15. The circuit of claim 14, further comprising a resistive divider stage coupled to said input to provide said DC input voltage reference.

16. The circuit of claim 14, wherein the feedback capacitor is coupled to receive the AC voltage proportional to the lamp current developed across a sensing resistor disposed in series with the lamp.

17. The circuit of claim 16, wherein the driver circuit, oscillator circuit and dimming control circuit are contained in an integrated circuit package, and said input is a single pin of said integrated circuit package, whereby said single pin functions as an input to receive said DC input voltage to set the desired dimming level of the lamp and receives said AC lamp current feedback signal to maintain said lamp at the desired dimming level determined by said DC input voltage.

18. A dimming ballast control circuit for driving a ballast power switching circuit powering a gas discharge lamp comprising:

a driver circuit for driving high and low side switches of the ballast power switching circuit;

a control circuit for driving the driver circuit including an oscillator circuit for providing an oscillating signal to control the frequency of operation of the ballast power switching circuit, the ballast power switching circuit outputting lamp powering pulsed signals;

a dimming control circuit having an input, the dimming control circuit receiving an AC lamp current feedback signal at the input, the dimming control circuit further receiving a DC input voltage reference at the input whereby the DC input voltage reference determines a desired dimming level of the lamp and the AC lamp current feedback signal maintains the lamp brightness at the desired dimming level; and a current and voltage sensing circuit for sensing the ballast power switching circuit current and a voltage at a switching mode between the high and low side switches and providing an output to a zero voltage switching protection circuit for providing non-zero voltage switching protection and further comprising a crest factor protection circuit.

19. The circuit of claim 18, further comprising:

a restart logic circuit for receiving a signal indicating lamp presence and providing a shutdown signal if the lamp is not present;

an under voltage lockout circuit; and a fault logic circuit receiving inputs from the restart logic circuit, an ignition detection circuit, the crest factor detection circuit, and under voltage lockout circuit and providing output to the driver circuit, wherein the oscillator circuit comprises a voltage-controlled oscillator receiving an input control signal (VCO) for setting the oscillator frequency and inputs from the ignition detection circuit and the dimming control circuit and providing the oscillating signal to drive the driver circuit.

20. The circuit of claim 19, further comprising an internal current source boost circuit for providing a charge to an external capacitor.

21. The circuit of claim 20, wherein the fault logic circuit further receives a frequency sweep time for a preheat/ignition mode.

22. The circuit of claim 21, wherein the input control signal, the frequency sweep time, and the charge to an external capacitor, are provided on a single pin.

23. The circuit of claim 19, wherein the driver circuit is connected to a signal low side switch and the restart logic circuit is coupled to the output of the driver circuit on a same single pin.

* * * * *